US008276556B2

(12) United States Patent
Knauf et al.

(10) Patent No.: US 8,276,556 B2
(45) Date of Patent: Oct. 2, 2012

(54) CONTINUOUSLY VARIABLE VALVETRAIN ACTUATOR HAVING A TORQUE-COMPENSATING MECHANISM

(75) Inventors: Michael B. Knauf, Rochester, NY (US); Jeffrey D. Rohe, Caledonia, NY (US); Hermes A. Fernandez, Pittsford, NY (US)

(73) Assignee: Delphi Technologies, Inc., Troy, MI (US)

( * ) Notice: Subject to any disclaimer, the term of this patent is extended or adjusted under 35 U.S.C. 154(b) by 654 days.

(21) Appl. No.: 12/431,880

(22) Filed: Apr. 29, 2009

(65) Prior Publication Data

US 2010/0275863 A1 Nov. 4, 2010

(51) Int. Cl.
*F01L 1/34* (2006.01)

(52) U.S. Cl. ..... 123/90.16; 123/90.39; 123/90.44; 74/569

(58) Field of Classification Search ..... 123/90.16, 123/90.39, 90.44; 74/569
See application file for complete search history.

(56) References Cited

U.S. PATENT DOCUMENTS 3,626,784 A * 12/1971 Johnson ..... 74/518
5,947,074 A * 9/1999 Yapici ..... 123/192.2

* cited by examiner

*Primary Examiner* — Ching Chang
(74) *Attorney, Agent, or Firm* — Thomas N. Twomey

(57) ABSTRACT

A mechanism for compensating systematic uni-directional torque bias imposed on a bi-directional drive actuator shaft, comprising a pallet disposed on an arm for rotation with the actuator shaft. A bucket tappet is engaged by the pallet and contains a helical compression spring. As the actuator shaft rotates and compresses the spring, the load on the pallet increases linearly but the length of the lever arm changes non-linearly at a rate different from the force applied to the pallet. This results in a non-linear torque about the actuator shaft. The torque can be the same at the compression spring preload state as it is at the full load state or it can be biased to be unsymmetrical based on the layout and size of the components and the stroke of the actuator shaft.

10 Claims, 13 Drawing Sheets

CONTINUOUSLY VARIABLE VALVETRAIN ACTUATOR HAVING A TORQUE-COMPENSATING MECHANISM

TECHNICAL FIELD

The present invention relates to continuously variable valve lift (CVVL) valvetrain actuation systems for internal combustion engines; more particularly, to a mechanism for compensating systematic uni-directional torque bias imposed on a bi-directional drive actuator shaft; and most particularly, to such a mechanism including a linear force helical compression spring.

BACKGROUND OF THE INVENTION

Variable valve actuation (VVA) systems are well known in the automotive arts for improving performance of internal combustion engines. Some known VVA systems employ a motor-driven actuator rod, also referred to herein as a "bi-directional actuator", for varying the contact position of a cam follower on an engine cam lobe. The present invention applies to actuator systems for variable valvetrains which experience an average drive torque favoring rotation of the bi-directional actuator in one direction and hindering rotation in the opposing direction. The present invention provides a means to optimally bias the average torque of a bi-directional drive actuator system toward zero. Thus, the present invention helps to provide more equal response time in either direction of rotation as well as to reduce the overall motor requirements for the system by reducing the overall peak-to-peak torque variation.

A mechanism which can provide a constant torque bias is not the optimal solution because it merely shifts the torque signature and does not change the overall peak-to-peak value.

What is needed in the art is a mechanism for compensating systematic uni-directional torque bias imposed on a bi-directional drive actuator shaft wherein the compensating bias torque is non-linear over the rotational range of authority of the actuator shaft and is desirably equal and opposite to the systematic torque differences.

It is a principal object of the present invention to help to balance the mechanism torques and reduce the overall peak-to-peak torque variation.

It is a further object of the invention to provide a significant benefit on packaging, assembly, and overall system cost.

SUMMARY OF THE INVENTION

Briefly described, a mechanism is provided for compensating systematic uni-directional torque bias imposed on a bi-directional drive actuator shaft. The mechanism comprises a circular pallet (preferably a roller) located radially at a fixed distance from the axis of rotation of the actuation shaft. The pallet is rigidly fixed to the to actuation shaft by an arm. A spring bucket tappet adjacent the pallet contains a helical compression spring and is allowed to move freely axially but is constrained in its motion radially. The operation of the mechanism is such that the length of the lever arm (the perpendicular distance from the actuator shaft axis of rotation to the contact point between the roller pallet and bucket tappet) changes at a rate different from the rate at which force is applied to the roller pallet. This in turn gives a non-linear torque about the actuator shaft. In the default position, the compression spring is in its preload state and the lever arm is the longest. As the actuator shaft rotates and compresses the spring, the load on the roller pallet increases linearly but because the pallet moves in an arc, the length of the lever arm changes non-linearly. In this way, the torque can be the same at the compression spring preload state as it is at the full load state or it can be biased to be unsymmetrical based on the layout and size of the components and the stroke of the actuator shaft.

BRIEF DESCRIPTION OF THE DRAWINGS

The present invention will now be described, by way of example, with reference to the accompanying drawings, in which.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENTS

Figure 1:
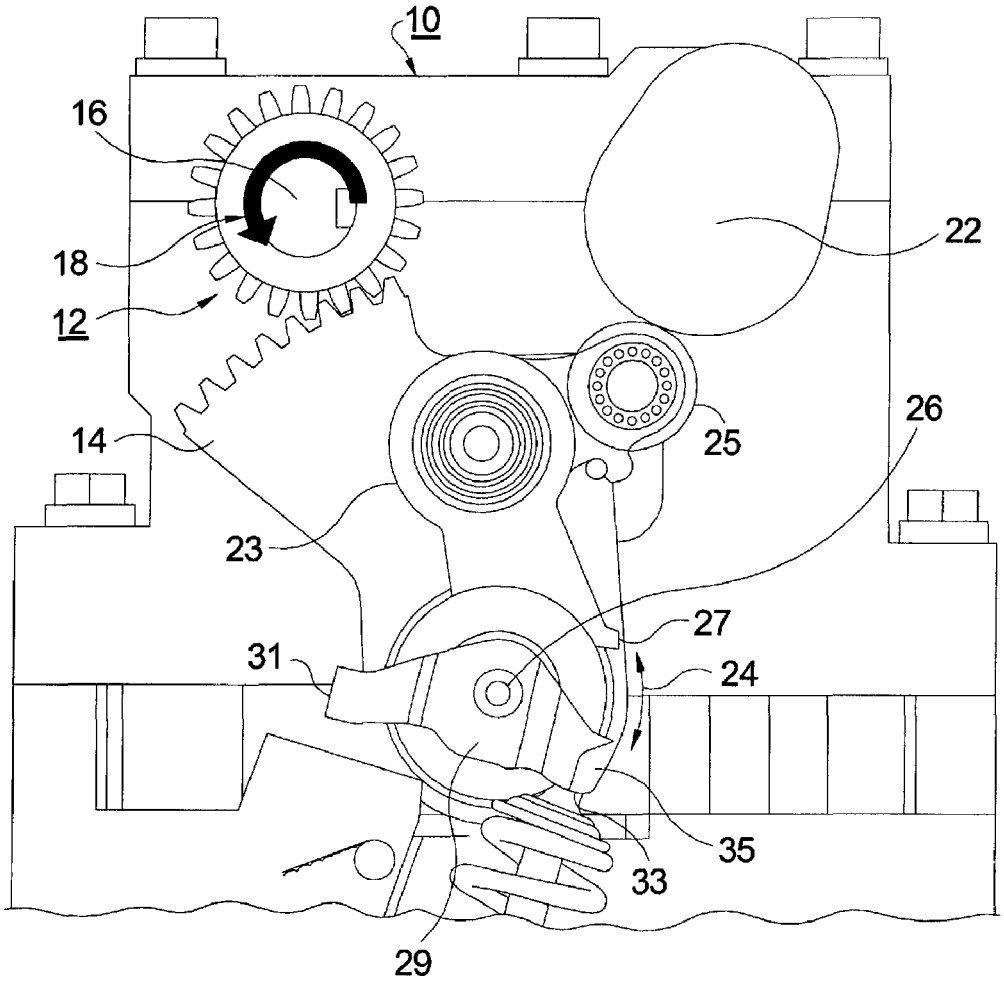
FIG. 1. (PRIOR ART)
FIG. 1 is an elevational view partially in cross-section of a prior art CVVL mechanism.
Figure 2:
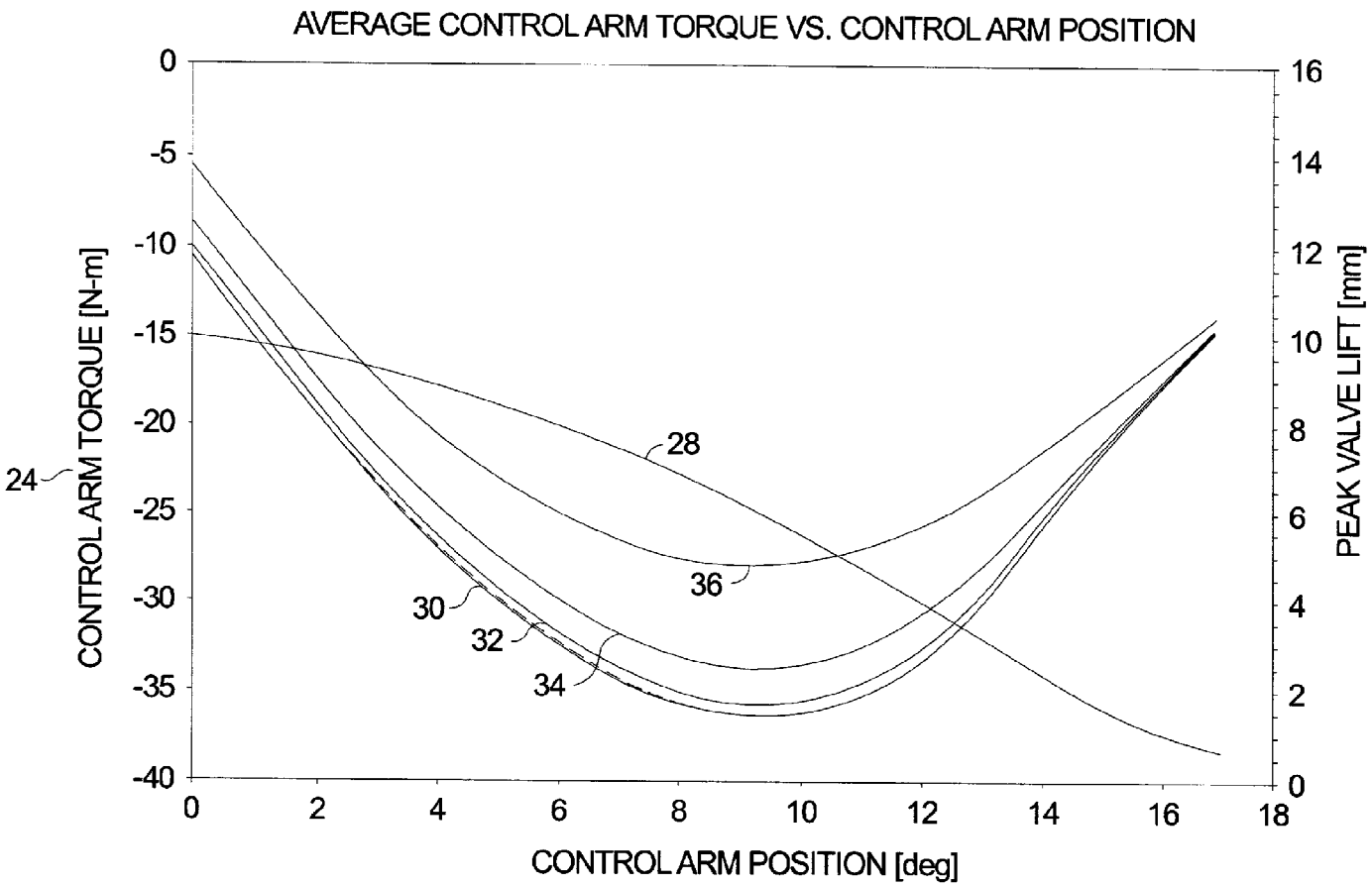
FIG. 2. (PRIOR ART)
FIG. 2 is a prior art driver and actuator used in conjunction with the assembly shown in FIG. 1, with components of the CVVL omitted for clarity.
Figure 3:
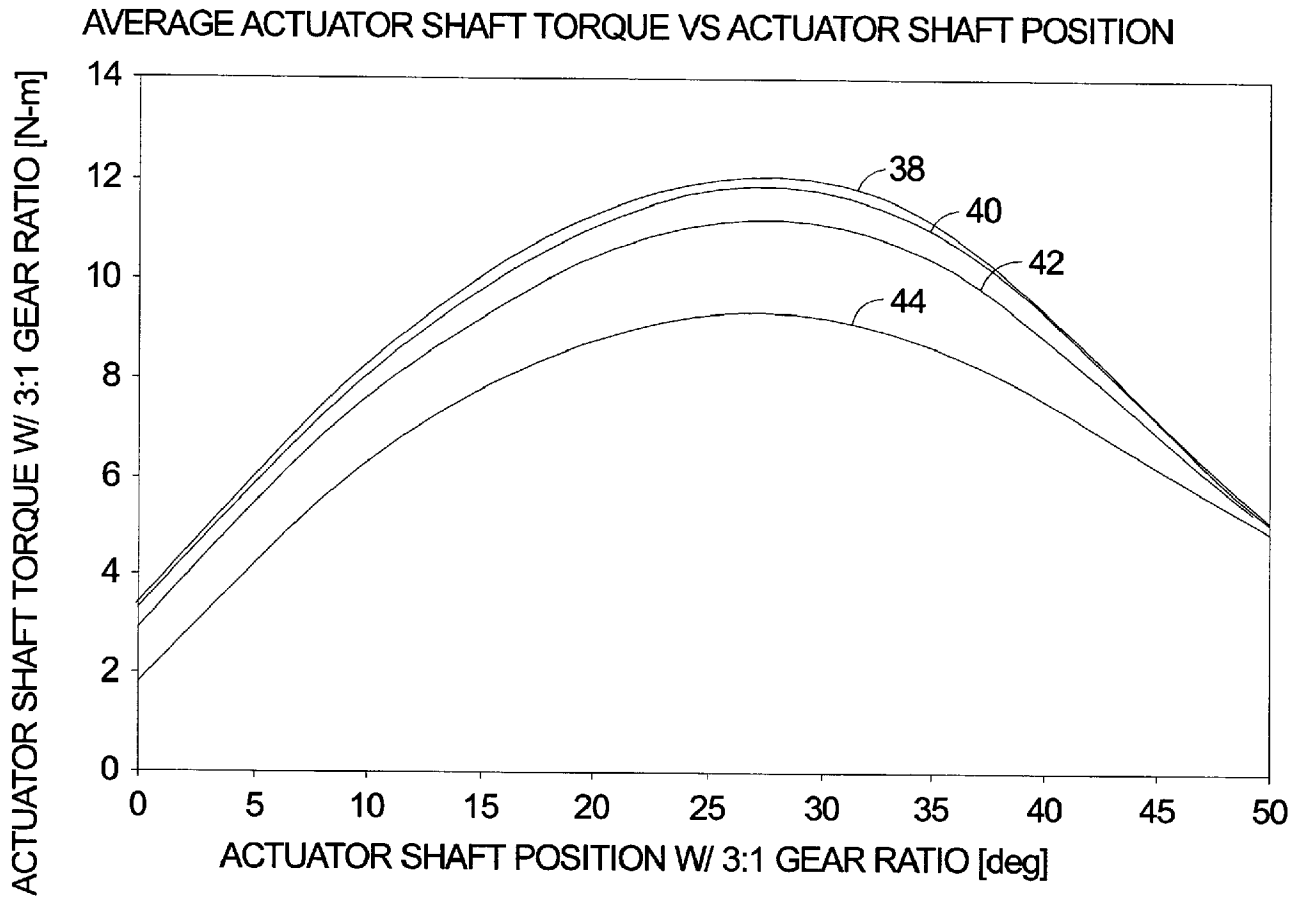
FIG. 3. (PRIOR ART)
FIG. 3 is a graph showing valve lift at a variety of control shaft positions of the CVVL mechanism shown in FIG. 1, and resulting average torque applied to the control arm due to CVVL mechanism forces at selected engine speeds.
Figure 4:
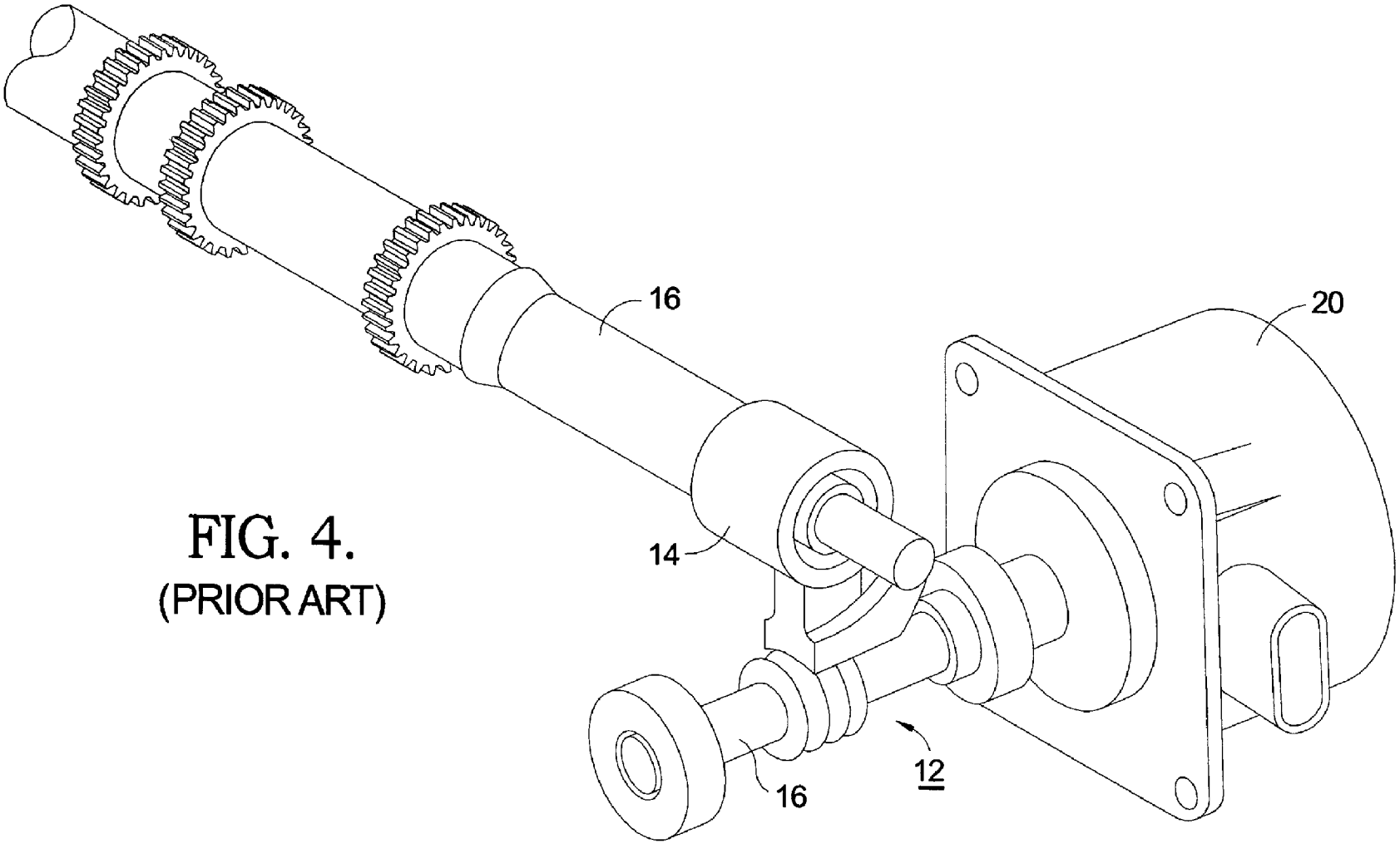
FIG. 4. (PRIOR ART)
FIG. 4 is a graph showing average torque applied to the actuator shaft due to CVVL mechanism forces.

Referring to FIGS. 1 and 2, an exemplary prior art CVVL variable valvetrain actuation mechanism 10 is shown to which the present invention applies. A gear 12 fixed to actuator shaft 16 acts to transmit torque 18 from a driver 20, such as for example a driver motor, through worm 19 and sector gear 21 to control arm 14, which is rotatable to position mechanism 10 at a continuously-variable lift imposed by a camshaft lobe 22. A cam follower 23 is pivotably mounted on control arm 14 and includes a contact face 25, such as for example a roller, following the surface of camshaft lobe 22 and a contoured shoe 27 engaging a rocker arm 29 pivotably disposed at a first end 31 on a support member such as a hydraulic lash adjuster 34 and engaging an engine valve 33 at a second end thereof 35. Due to dynamic and spring forces created within mechanism 10, a torque 24 is created in control arm 14 about control arm pivot 26 that varies with control arm position and engine speed, as shown in FIG. 3. Valve lift 28 is shown as a function of control arm angular position, and average control arm torque 24 is shown at test engine speeds of 600 rpm (30), 2000 rpm (32), 4000 rpm (34), and 7000 rpm (36). Torque 24 is then reduced through gear 12 and transmitted back to actuator shaft 16 as shown in FIG. 4. Average actuator shaft torque 18 is shown for test engine speeds of 600 rpm (38), 2000 rpm (40), 4000 rpm (42), and 7000 rpm (44) over a range of actuator shaft rotary positions. Because all these torque curves are biased in one direction (positive), it makes for an inefficient bi-directional drive system. Motor 20 must have sufficient torque to overcome the highest torques in one direction but then has an excess of torque when driving in the opposing direction. Therefore, a supplementary mechanism is needed to bias this torque so that it is more symmetric about zero, making for smaller motor requirements for the system shown in FIGS. 1 and 2. It is further desirable to reduce the total peak-to-peak torque variation.

Figure 6:
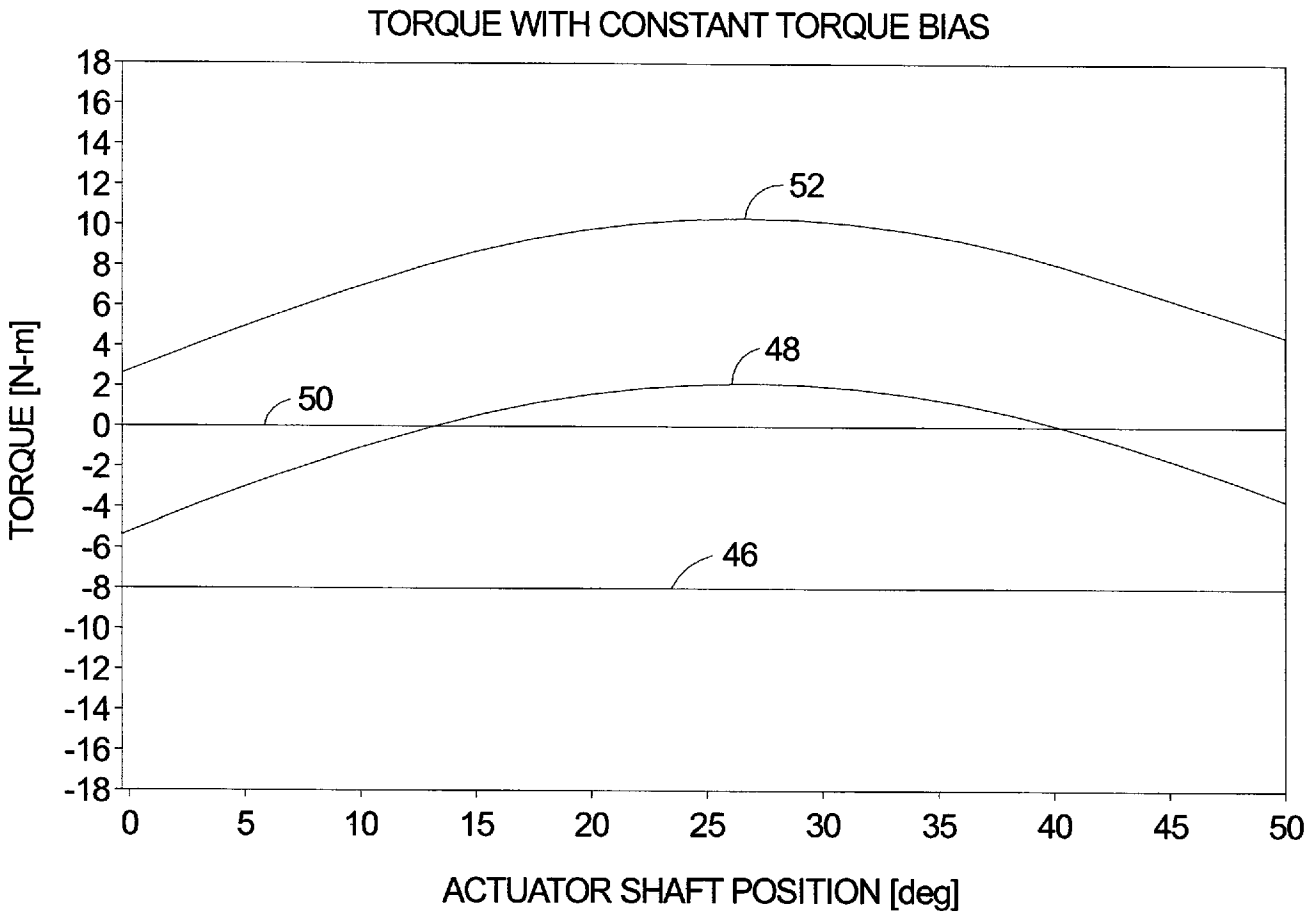
FIG. 6 is a graph showing the torque effect of an ideal, zero rate, constant preload torsion spring arrangement shown in FIG. 5.

Optimization studies for motor sizing have been conducted using Monte Carlo simulation to vary combinations of parameters to find the optimal configuration. Bias torque was varied as a constant parameter in this study and was chosen to match the smallest motor size that could safely drive that system under worst case conditions. Results of using a constant torque bias 46 on actuator shaft 16 are shown in FIG. 6. It can be seen that net torque 48 is more centered on zero and that the average 50 of the net torque is zero, whereas the average 52 of the net torque without bias is substantially positive.

Figure 5:
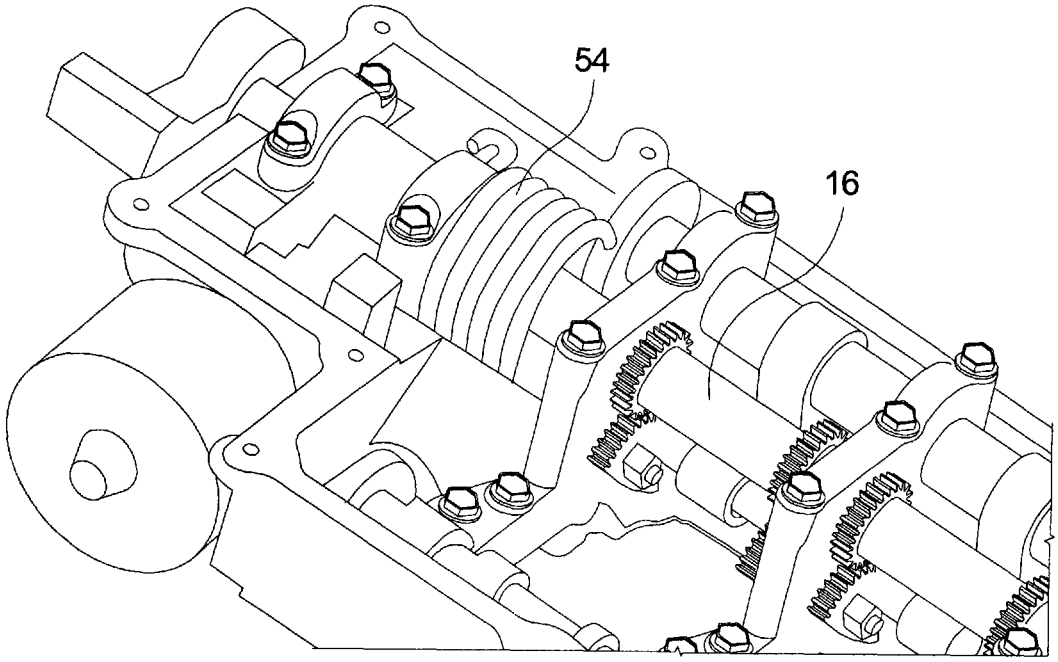
FIG. 5 is an isometric view of a portion of an engine head showing a linear torsion spring attached to the CVVL actuator shaft.
Figure 7:
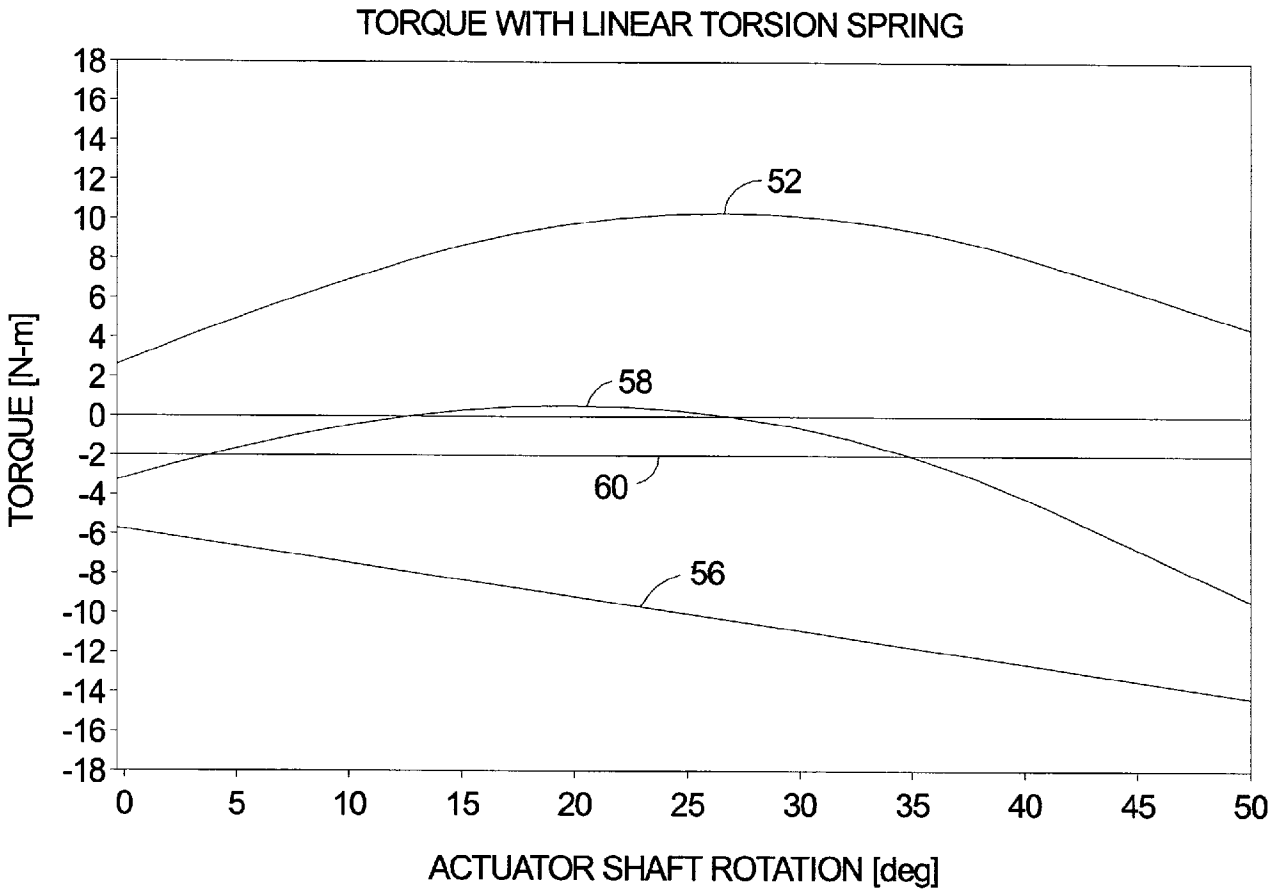
FIG. 7 is a graph like that shown in FIG. 6 but having an actual linear torsion spring with a finite rate and preload.

The results shown in FIG. 6 may be provided by incorporating a linear torsion spring 54 on actuator shaft 16 as shown in FIG. 5. The effect of such a spring can be seen in FIG. 7. Spring 54 must be selected as a compromise to the constant bias value 56 that was determined from the Monte Carlo analysis. The resulting sum of the linear bias and mechanism torque is shown in curve 58, and the average 60 of curve 58 is not zero but rather slightly negative. Spring 54 should have a large preload and very low stiffness.

Although not ideal, spring 54 can help to balance out the positive and negative torques and thus to lower actuator requirements. However, another drawback of using a torsion spring of this type is that it must be very large to produce the desired preload and stiffness. To accommodate this, dual torsion spring designs have been considered to approach the desired benefits in terms of bias torque and packaging size improvement.

Referring now to FIGS. 8 through 12, a non-linear torque bias assembly 100 in accordance with the present invention is readily and economically applicable to a prior art CVVL mechanism such as mechanism 10 shown in FIG. 1. Assembly 100 is formed of simple components including a linear compression spring and includes geometric relationships applied in a way to create a non-linear torque signature. The novelty of the present invention is not necessarily in its configuration but in its application to a bi-directional drive system used for position control of a mechanical variable lift valvetrain system and for balancing the torque that is inherently created by the valvetrain's operation.

Figure 8:
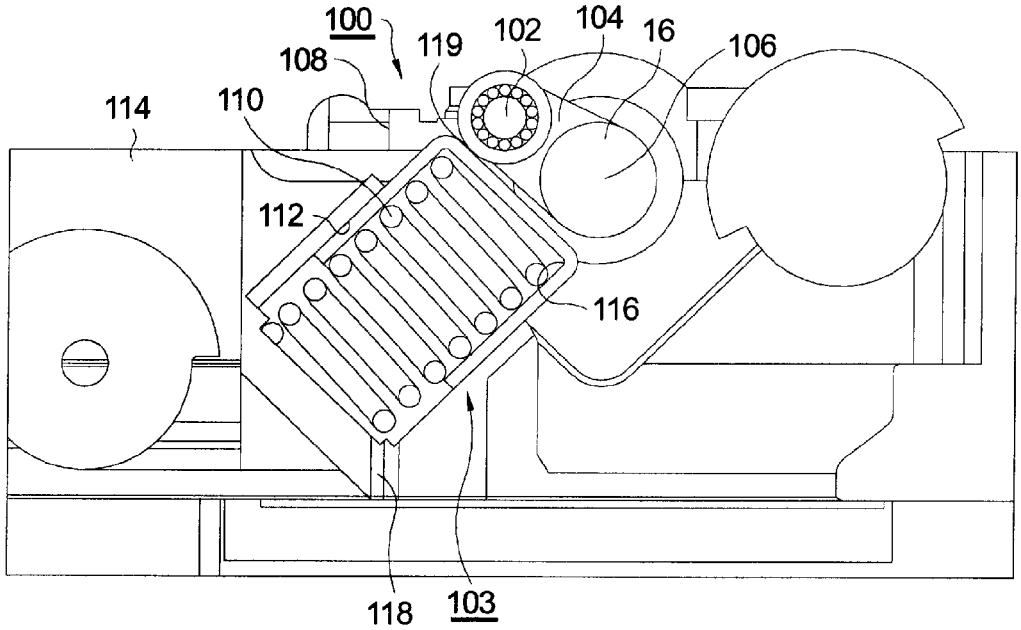
FIG. 8 is an elevational cross-sectional view of a bias linear compression spring mechanism that can produce a non-linear torque bias curve in accordance with the present invention.

FIG. 8 shows a cross-sectional view of assembly 100 and related components in a current embodiment. Assembly 100 comprises contact pallet 102, such as for example a circular roller, attached to actuation shaft 16 by an arm 104 having a fixed length from the axis of rotation 106 of actuation shaft 16. Assembly 100 further comprises a linearly-variable force-resistance sub-assembly 103 preferably in the form of a spring bucket tappet 108 and helical compression spring 110. Spring bucket tappet 108 rides in a bore 112 in carrier 114 which allows tappet 108 to move freely axially but constrains its motion radially. Tappet 108 is fit with a relatively tight clearance to bore 112 to reduce axial tipping which increases friction during operation, although the clearance must be large enough to eliminate seizure at low temperatures due to differences in thermal expansion between the tappet, which preferably is formed of steel, and the carrier, which typically is formed of aluminum. Preferably, a small step 116 is provided in the upper portion of bucket tappet 108 wherein the diameter is decreased to help contain compression spring 110 and keep it from wandering. An oil drain hole 118 at the bottom of bore 112 in carrier 114 keeps the assembly from filling with oil and hydro-locking.

The operation of assembly 100 is such that the length of the lever arm (the perpendicular distance from actuator shaft axis of rotation 106 to the contact point 119 between pallet 102 and bucket tappet 108) changes at a rate different from the rate of change of force applied to pallet 102. This in turn gives a non-linear torque about actuator shaft 16. In the default position as shown in FIG. 8, compression spring 110 is in its preload state and lever arm 143 (FIG. 11) created by the offset roller pallet is the largest. As actuator shaft 16 rotates and thereby compresses spring 110, the load on the pallet 102 increases linearly but because pallet 102 moves in an arc, the length of the lever arm changes non-linearly. Hence, the bias torque can be the same at the compression spring preload state as it is at the full load state or it can be biased to be unsymmetrical based on the layout and size of the components and the stroke of the actuator shaft.

Figure 9:
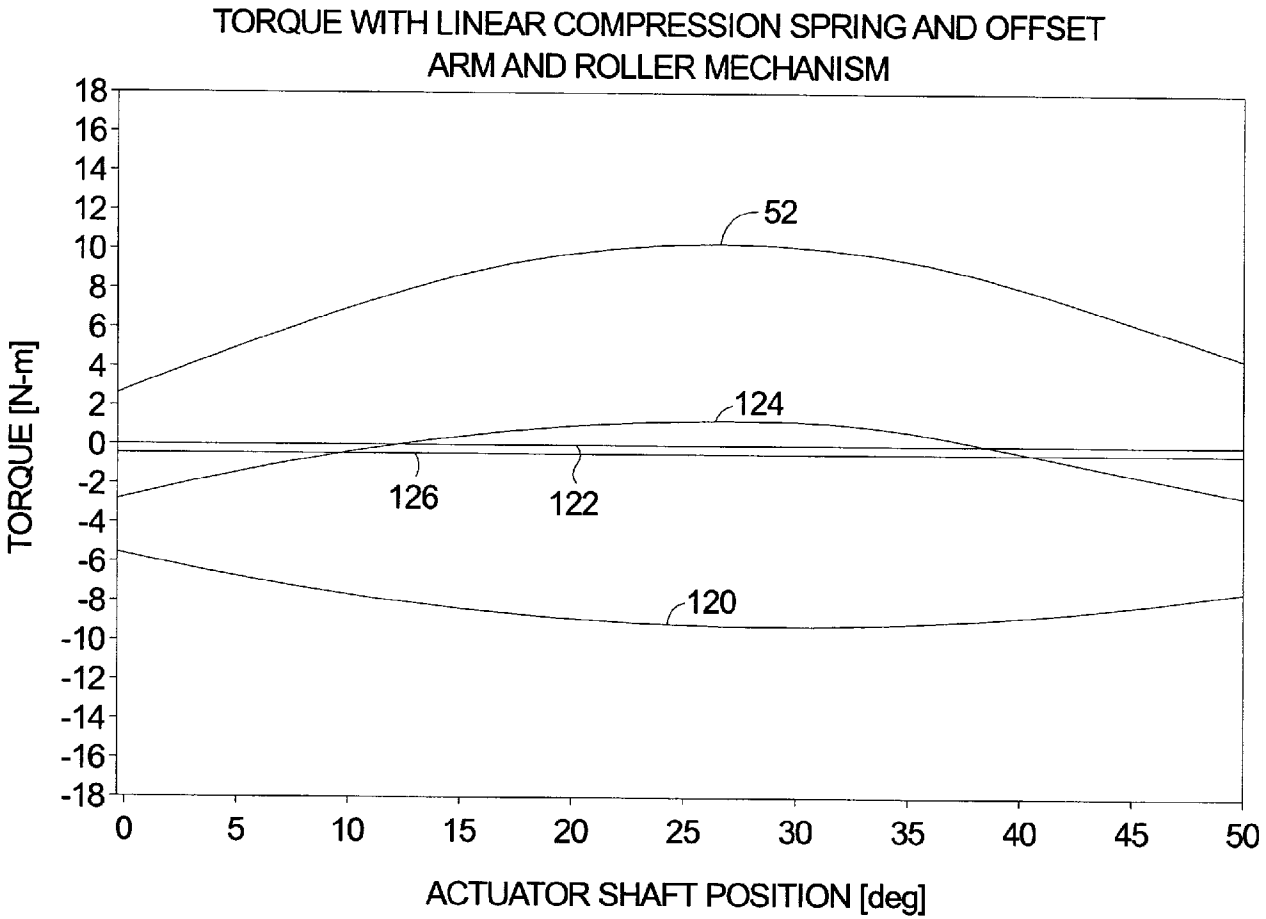
FIG. 9 is a graph showing torque performance of a linear bias spring mechanism having an offset arm and roller mechanism after optimized for a specific variable valvetrain mechanism layout.

FIG. 9 shows the performance of assembly 100 after being optimized for a specific variable valvetrain mechanism layout. Note that the concavity of the bias mechanism torque curve 120 is opposite the convexity of the mechanism torque curve 52. This inherently reduces the average peak-to-peak torque variation over the range of actuator shaft authority because the shape of bias mechanism torque curve 120 tends to mirror mechanism torque curve 52. Also note the asymmetry of the bias torque curve and the mechanism torque curve. As was previously stated, the torque at the ends of travel can be tailored to more closely match the mechanism curve. Another advantage is that the average 122 of the net torque curve 124 is very close to zero 126, unlike that shown for the linear torsion spring arrangement shown in FIGS. 5 and 7.

Figure 10:
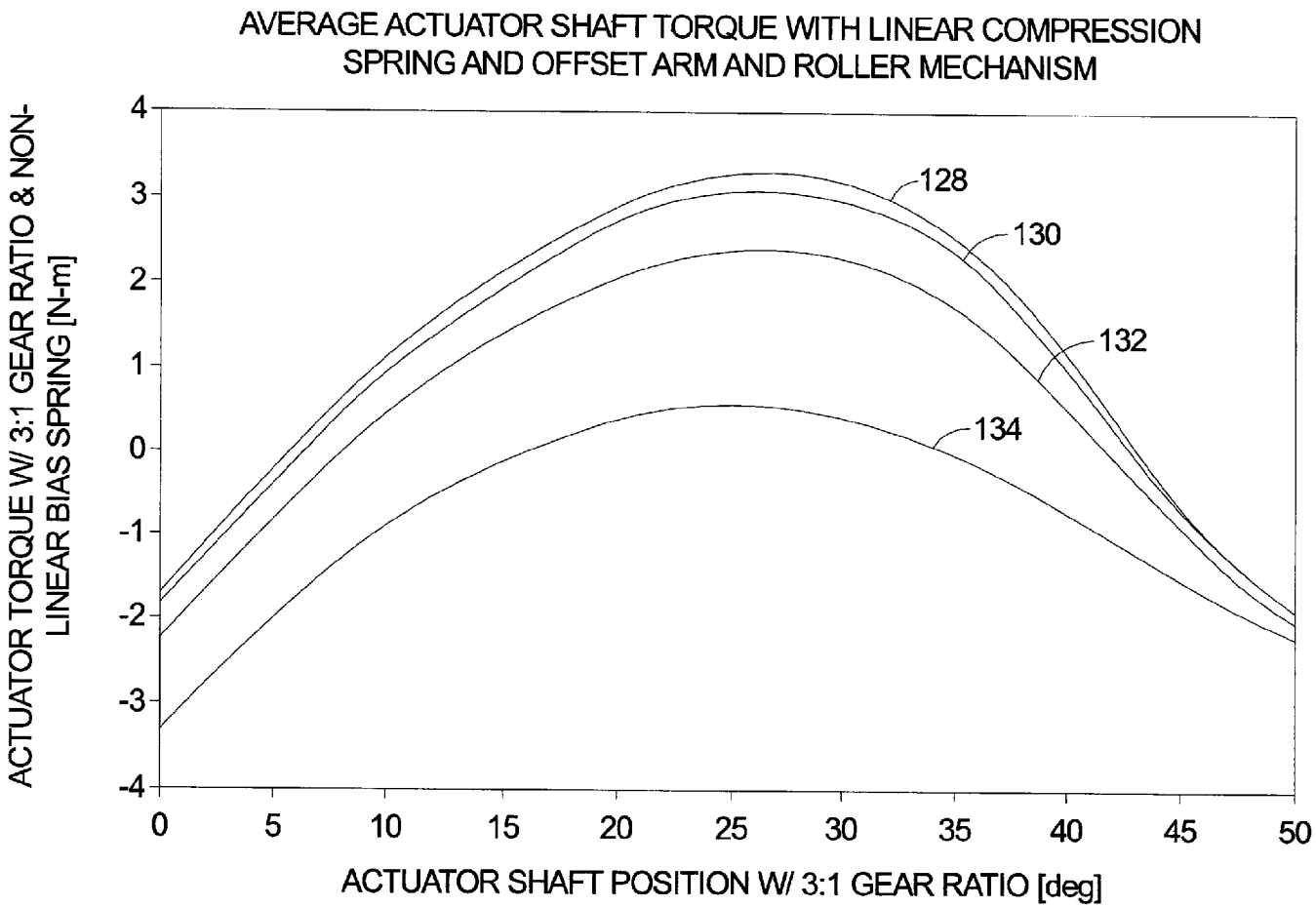
FIG. 10 is a graph showing results for a linear bias spring mechanism having an offset arm and roller mechanism when exemplarily chosen to limit actuator shaft peak torque values to ±3.3 N-m over the entire operating range.

FIG. 10 shows results for assembly 100 when exemplarily optimized to limit average actuator shaft peak torque values to ±3.3 N-m over the entire engine operating range. This is the optimal solution for the particular gear ratio between the actuator shaft and control arm of 3:1 and permits a decrease in motor size and power requirements as well as balancing the response times for CVVL mechanism 10 in both directions. The various curves represent actuator shaft torques at a variety of engine speeds: 600 rpm (128), 2000 rpm (130), 4000 rpm (132), and 7000 rpm (134). Note further that CVVL mechanism 10 without the present invention exhibits an average actuator shaft torque range of about 10 Nm over the full range of actuator shaft authority (curves 38-44 in FIG. 4), whereas the same CVVL mechanism equipped with the invention exhibits an average actuator shaft torque range of only about 6.6 Nm (curves 128-134 in FIG. 10), a desirable peak-to-peak torque range reduction of nearly 40%.

Figure 11:
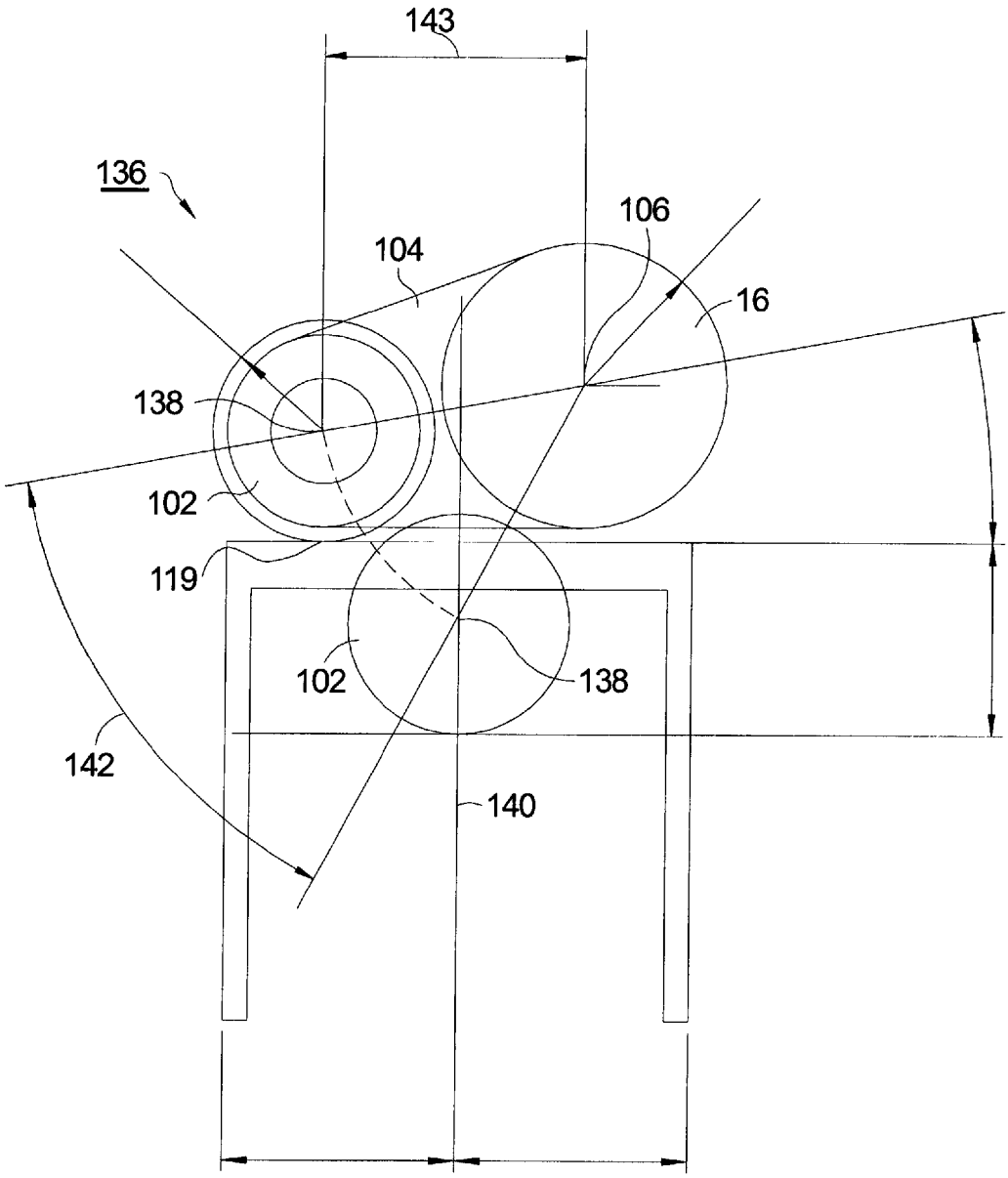
FIG. 11 is a schematic drawing of the geometric relationships in a CVVL system equipped in accordance with the present invention.

FIG. 11 illustrates the geometric relationships 136 described thus far and shows that a preferred layout is to align the axis 138 of pallet 102 with the centerline 140 of compression spring 110 when the spring is compressed to its full load state through actuator shaft stroke 142. This configuration helps to minimize the amount of friction generated between bucket tappet 108 and bore 112. This occurs because when the spring force is the greatest, tappet 108 sits concentric in bore 112 with no side loading forces. Because the side forces increase with increasing spring load, it is most logical to align pallet 102 and spring centerline 140 at the maximum stroke of the spring. By this method, the bias mechanism is further optimized to reduce the amount of hysteresis that will be introduced into the CVVL system 10 due to sliding friction between the tappet and its bore.

Figure 12:
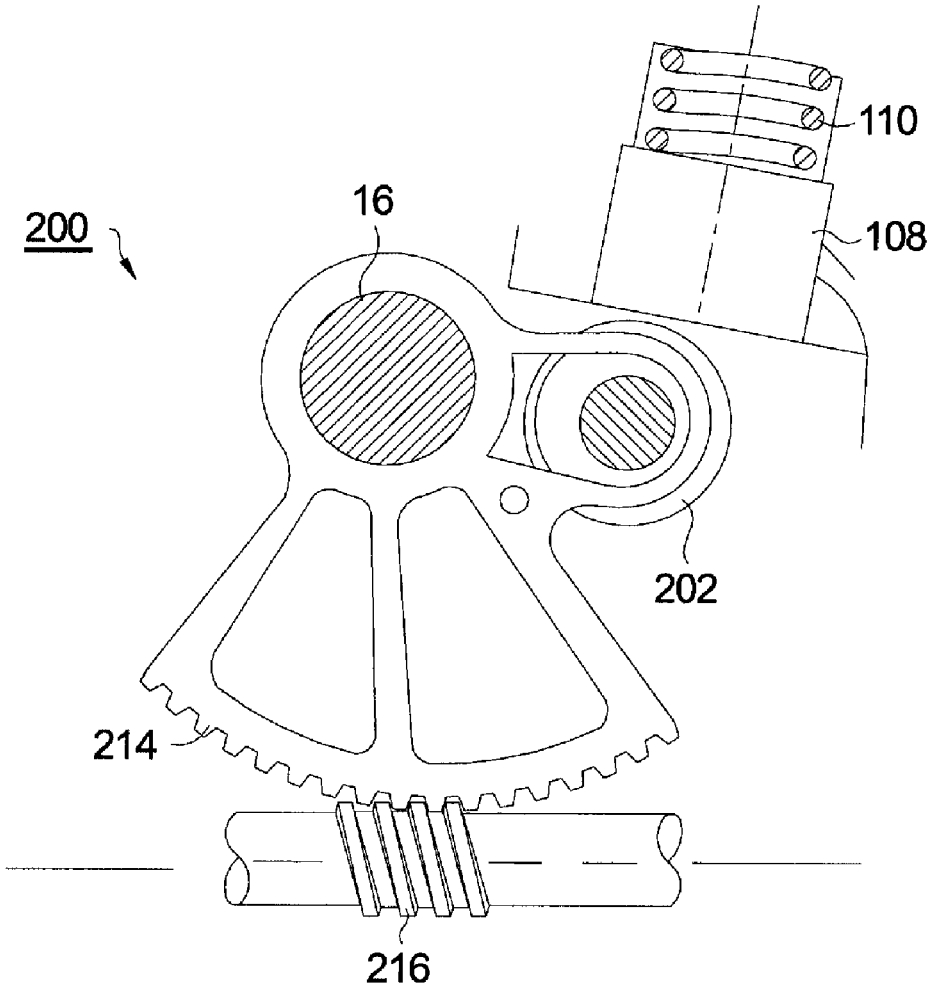
FIG. 12 is an elevational view of a second embodiment incorporating a roller pallet with sector gear for use in conjunction with a worm gear, as shown in FIG. 2.

Referring to FIG. 12, another embodiment 200 of the present invention involves incorporating a pallet 202 (a circular roller pallet is shown) with sector gear 221 used in conjunction with a worm 219 at the motor interface. FIG. 12 shows a pallet 202 integrated into sector gear 221 which then interfaces with spring bucket tappet 108 and compression spring 110 located in the carrier. This configuration simplifies manufacturing and assembly in that the gear and arm can be cast as one piece 220 and machined, and then roller pallet 202 is installed and the assembly pressed onto the actuator shaft 16 as a single unit.

Figure 13:
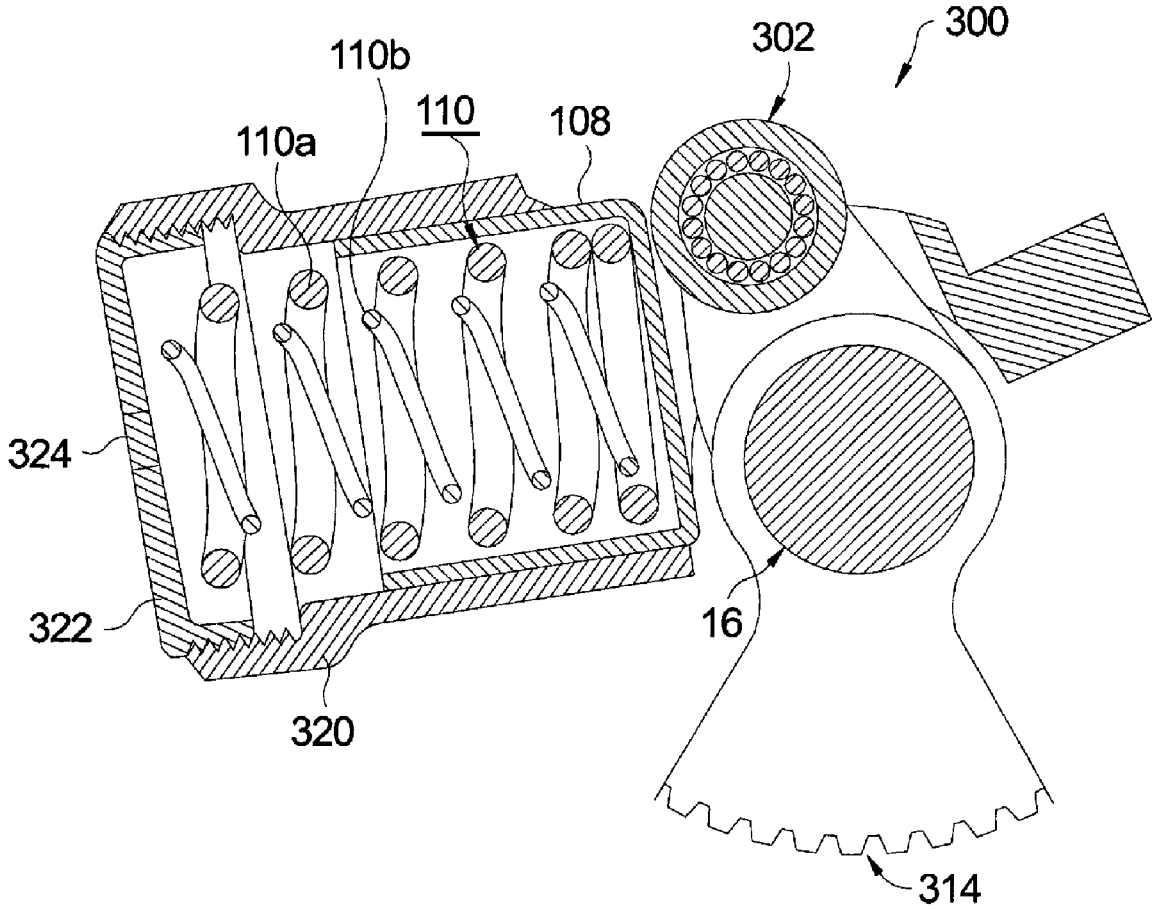
FIG. 13 is an elevational cross-sectional view of a third embodiment incorporating a roller pallet with sector gear and having a spring housing formed integrally with a bearing cap of an actuator shaft bearing.

FIG. 13 shows still another embodiment 300 comprising a contact pallet 302 integrated into sector gear 321 which then interfaces with spring bucket tappet 108 and compression spring 110. Preferably, the compression spring comprises first and second concentric compression springs 110*a*, 110*b* having differing spring constants to reduce packaging size. A spring housing 320 replaces the bore in the carrier in previously-described embodiments and instead is integral with a bearing cap for the actuator shaft. Housing 320 may be conveniently closed by a threaded plug 322 after the springs are inserted through the threaded end. Plug 322 preferably includes an oil weep hole 324.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A torque bias assembly for compensating for differences in systematic torques imposed on an actuator shaft, comprising:

a) a pallet radially offspaced on an arm extending from the rotational axis of said actuator shaft and rotatable with said actuator shaft; and b) a variable force-resistance sub-assembly driven by said pallet to exert a resistive bias torque on said actuator shaft during rotation of said actuator shaft.

2. An assembly in accordance with claim 1 wherein said variable force-resistance sub-assembly includes a bucket tappet driven by said pallet and a compression spring engaged by said bucket tappet.

3. An assembly in accordance with claim 2 wherein said resistive bias torque is linear.

4. An assembly in accordance with claim 2 wherein resistive bias torque is non-linear.

5. An assembly in accordance with claim 2 wherein at one extreme of rotational authority of said actuator shaft the axis of said pallet is coincident with a longitudinal bisector of said bucket tappet.

6. An assembly in accordance with claim 2 wherein said compression spring is disposed in a spring housing integral with a bearing cap of said actuator shaft.

7. An assembly in accordance with claim 1 wherein said arm is attached to said actuator shaft.

8. An assembly in accordance with claim 5 wherein said arm further includes a sector gear.

9. A system for continuously variable valve lift actuation in an internal combustion engine, comprising:

a) a control arm pivotably disposed about a control arm axis and including a gear;

b) a follower pivotably disposed on said engine for opening and closing an engine valve;

c) a cam follower rotatably disposed on said control arm between said follower and a cam lobe of said engine, including a contact pad for engaging said cam lobe and a shoe for engaging said follower;

d) a drive gear disposed on an actuator shaft and engaged with said control arm gear for selective rotation thereof;

e) a driver operationally connected to said actuator shaft;

f) a pallet radially offspaced on an arm extending from the rotational axis of said actuator shaft and rotatable with said actuator shaft; and g) a variable resistance sub-assembly driven by said pallet to exert a resistive bias torque on said actuator shaft during rotation of said actuator shaft.

10. An internal combustion engine comprising a system for continuously variable valve lift actuation in at least one combustion valve, wherein said system includes a control arm pivotably disposed about a control arm axis and including a gear, a follower pivotably disposed on said engine for opening and closing an engine valve, a cam follower rotatably disposed on said control arm between said follower and a cam lobe of said engine, including a contact pad for engaging said cam lobe and a shoe for engaging said follower, a drive gear disposed on an actuator shaft and engaged with said control arm gear for selective rotation thereof, a driver operationally connected to said actuator shaft, a pallet radially offspaced on an arm extending from the rotational axis of said actuator shaft and rotatable with said actuator shaft, and a variable resistance sub-assembly driven by said pallet to exert a resistive torque on said actuator shaft during rotation of said actuator shaft.

* * * * *